US007621726B2

(12) United States Patent
Bächner et al.

(10) Patent No.: US 7,621,726 B2
(45) Date of Patent: Nov. 24, 2009

(54) METERING PUMP

(75) Inventors: Stefan Bächner, Ramshalden (DE); Oliver Brodbeck, Metzingen-Neuhausen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 806 days.

(21) Appl. No.: 11/034,545

(22) Filed: Jan. 13, 2005

(65) Prior Publication Data

US 2005/0158192 A1 Jul. 21, 2005

(30) Foreign Application Priority Data

Jan. 15, 2004 (DE) ..... 10 2004 002 245

(51) Int. Cl.
*F04B 17/04* (2006.01)
*F04B 7/04* (2006.01)
*F04B 39/10* (2006.01)

(52) U.S. Cl. ..... 417/501; 417/417; 417/490; 417/570

(58) Field of Classification Search ..... 417/417, 417/501, 569, 570, 490, 493
See application file for complete search history.

(56) References Cited

U.S. PATENT DOCUMENTS 4,915,602 A * 4/1990 Tschopp ..... 417/503
5,713,723 A * 2/1998 Hathaway ..... 417/63
5,860,798 A * 1/1999 Tschopp ..... 417/502

FOREIGN PATENT DOCUMENTS

DE 200 19 406 1/2001
EP 1 239 221 9/2002

* cited by examiner

*Primary Examiner*—Devon C Kramer
*Assistant Examiner*—Philip Stimpert
(74) *Attorney, Agent, or Firm*—McGlew and Tuttle, P.C.

(57) ABSTRACT

A metering pump, especially for feeding fuel to a vehicle heater, comprising a delivery plunger (50), which can be moved to and fro for delivering liquid medium, a guide sleeve (42), which partially accommodates the delivery plunger (50) and guides same for the reciprocating movement, wherein the guide sleeve (42) with an inner surface (46) thereof defines a pump ejection chamber (48) and it defines with an outer surface (60) thereof a channel arrangement (74) leading to the pump ejection chamber (48), wherein the guide sleeve (42) is carried in a carrier element (24) and is in contact with the carrier element (24) by its outer surface (60) essentially over the entire circumference in a first length area (58) and is located with its outer surface at a spaced location from the carrier element (24) in a second length area (64), wherein the channel arrangement (74) is provided between the carrier element (24) and the guide sleeve (42) in its second length area (64), is characterized in that in its second length area (64), the guide sleeve (42) has at least one support area (78, 80, 82, 84), with which it is supported in relation to the carrier element (24).

10 Claims, 2 Drawing Sheets

METERING PUMP

CROSS REFERENCE TO RELATED APPLICATIONS

This application claims the benefit of priority under 35 U.S.C. § 119 of German Application DE 10 2004 002 245.3 filed Jan. 15, 2004, the entire contents of which are incorporated herein by reference.

FIELD OF THE INVENTION

The present invention pertains to a metering pump, with which, for example, liquid fuel can be delivered to a heater in a vehicle.

BACKGROUND OF THE INVENTION

Such metering pumps comprise, in general, a delivery plunger, which can be moved to and fro for delivering the liquid fuel and is accommodated and guided for this purpose, for example, in a guide sleeve. Due to its reciprocating movement, the plunger dips more or less deeply into the guide sleeve depending on its movement cycle. The liquid fuel is ejected in this manner from a pump ejection chamber, which is also defined by an inner surface of the guide sleeve, namely, when the delivery plunger is being moved in the direction in which the pump ejection chamber volume is minimized, or fuel can be taken up in the chamber, namely, when the delivery plunger is being moved in the direction in which the pump ejection chamber volume is maximized.

This guide sleeve is carried, in general, firmly in a carrier element, which may be part of a housing of the metering pump or in such a housing. To make it possible to guide the liquid fuel in the direction of the pump ejection chamber, a circumferential distance is present between an outer surface of the guide sleeve and the carrier element, which carries the guide sleeve per se, so that an annular flow space is formed. This leads in the direction of the pump ejection chamber. In another length area, the guide sleeve is in contact with the carrier element essentially over the entire circumferential area, so that stable mounting of the guide sleeve is ensured by press fit, on the hand, and, on the other hand, the annular channel area is axially defined and it is ensured that no liquid fuel can escape in the transition between the carrier element and the guide sleeve. To achieve the stable mounting of the guide sleeve, the latter must be made, in general, of a metallic material, so that this mounting is brought about in a comparatively short length area by the contact between the guide sleeve and the carrier element, while the annular intermediate space, in which there is no contact between the guide sleeve and the carrier element, is then formed in a longer section. This is also due to the fact that such guide sleeves are brought, in general, to the desired dimensions by a turning operation, so that, in principle, a rotationally symmetrical outer surface is obtained, as a consequence of which the load-bearing contact with the carrier element is present only in a predetermined length area.

SUMMARY OF THE INVENTION

The primary object of the present invention is to provide a metering pump which has improved operating characteristics along with a simplified and less expensive design.

This object is accomplished according to the present invention by a metering pump, especially for feeding fuel to a vehicle heater, comprising a delivery plunger, which can be moved to and fro to deliver liquid medium; a guide sleeve, which partially accommodates the delivery plunger and guides same for the reciprocating movement, wherein the guide sleeve with an inner surface thereof defines a pump ejection chamber and it defines with an outer surface thereof a channel arrangement leading to the pump ejection chamber, wherein the guide sleeve is carried in a carrier element and is in contact by its outer surface with the carrier element in a first length area essentially over the entire circumference and is located at a spaced location with its outer surface from the carrier element in a second length area, wherein the channel arrangement is provided between the carrier element and the guide sleeve in its second length area, wherein the guide sleeve has at least one support area in its second length area, with which said support area the guide sleeve is supported in relation to the carrier element.

Various advantageous aspects are obtained with the metering pump according to the present invention. Thus, the embodiment of the guide sleeve with at least one support section in the length area in which the guide sleeve also defines the channel arrangement makes it possible to achieve better distribution of the supporting or carrying action in relation to the carrier element over the length of the guide sleeve. This means that the length area in which there is essentially a full-area circumferential contact in relation to the carrier element is relieved of its support function, which is also significant for the correct functionality of the metering pump, because better distribution can be obtained over the entire length area of the guide sleeve. This in turn makes it possible not to manufacture the guide sleeve of metal, but, e.g., of a plastic. In case of the configuration known from the state of the art, the use of a guide sleeve made of plastic implies, in principle, the problem that if the carrying function is limited to a comparatively short length area, namely, the length area in which no annular channel is formed, there is a risk of tilting of the guide sleeve because of the markedly higher elasticity and flexibility of the plastic material compared with metallic material. However, this risk of tilting can also be prevented from occurring even when a plastic material is used due to the fact that additional supporting is provided in the metering pump according to the present invention in the length area that is also used to feed the fuel. On the other hand, the use of plastic material makes it possible to design the guide sleeve as is specified in the metering pump according to the present invention, i.e., with support sections in certain length areas, i.e., with a shape that is, in principle, not rotationally symmetrical, e.g., by manufacturing according to an injection molding method. Due to the possibility of using materials other than metal due to the preset shape, the material can in turn be selected such that the operating characteristics are improved, namely concerning the frictional characteristics between the delivery plunger movable to and fro and the guide sleeve. Especially low-friction plastics can be used here, so that the service life of a metering pump designed according to the present invention can be markedly increased.

Provisions may be made, for example, in the metering pump according to the present invention for the guide sleeve to have an outer surface that is set back in relation to the first length area in its second length area in at least one circumferential area. It is possible now, for example, to provide a support section projecting over the set-back outer surface in the area of the set-back outer surface.

To obtain a support function in the second length area as well, which approximately corresponds to the support in the first length area, it is proposed, furthermore, that the support section project over the set-back outer surface up to the level of the outer surface in the first length area.

To provide a transition between the channel arrangement and the pump ejection chamber, it is proposed that at least one passage opening leading to the pump ejection chamber be provided in the area in which the first length area adjoins the second length area.

To obtain the largest possible flow cross section in the area of the channel arrangement despite the possibility of also providing a support for the guide sleeve in relation to the carrier element in the second length area, it is proposed, furthermore, that a set-back outer surface be provided at two circumferential areas, which are located essentially opposite each other, in the second length area.

Furthermore, the metering pump according to the present invention may be designed such that the guide sleeve defines the pump ejection chamber essentially in its first length area and it defines the channel arrangement essentially in its second length area.

According to another aspect of the present invention, the guide sleeve in the metering pump may be designed such that in its second length area, the guide sleeve has an outer contour that corresponds to the outer contour of the guide sleeve in the first length area and is interrupted at at least one circumferential area by a depression, which is open toward the outside and forms the channel arrangement at least partially.

As was already mentioned above, it is a special aspect of the present invention that, especially also due to the design embodiment, the guide sleeve can be made of a plastic material, with the advantage that it is possible not only to use a material that is less expensive and can also be processed more easily and can be handled in an easier manufacturing process, but also to markedly improve the sliding properties during the guiding of the delivery plunger.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The present invention will be described below with reference to the drawings attached. In the drawings.

DESCRIPTION OF THE PREFERRED EMBODIMENT

Figure 1:
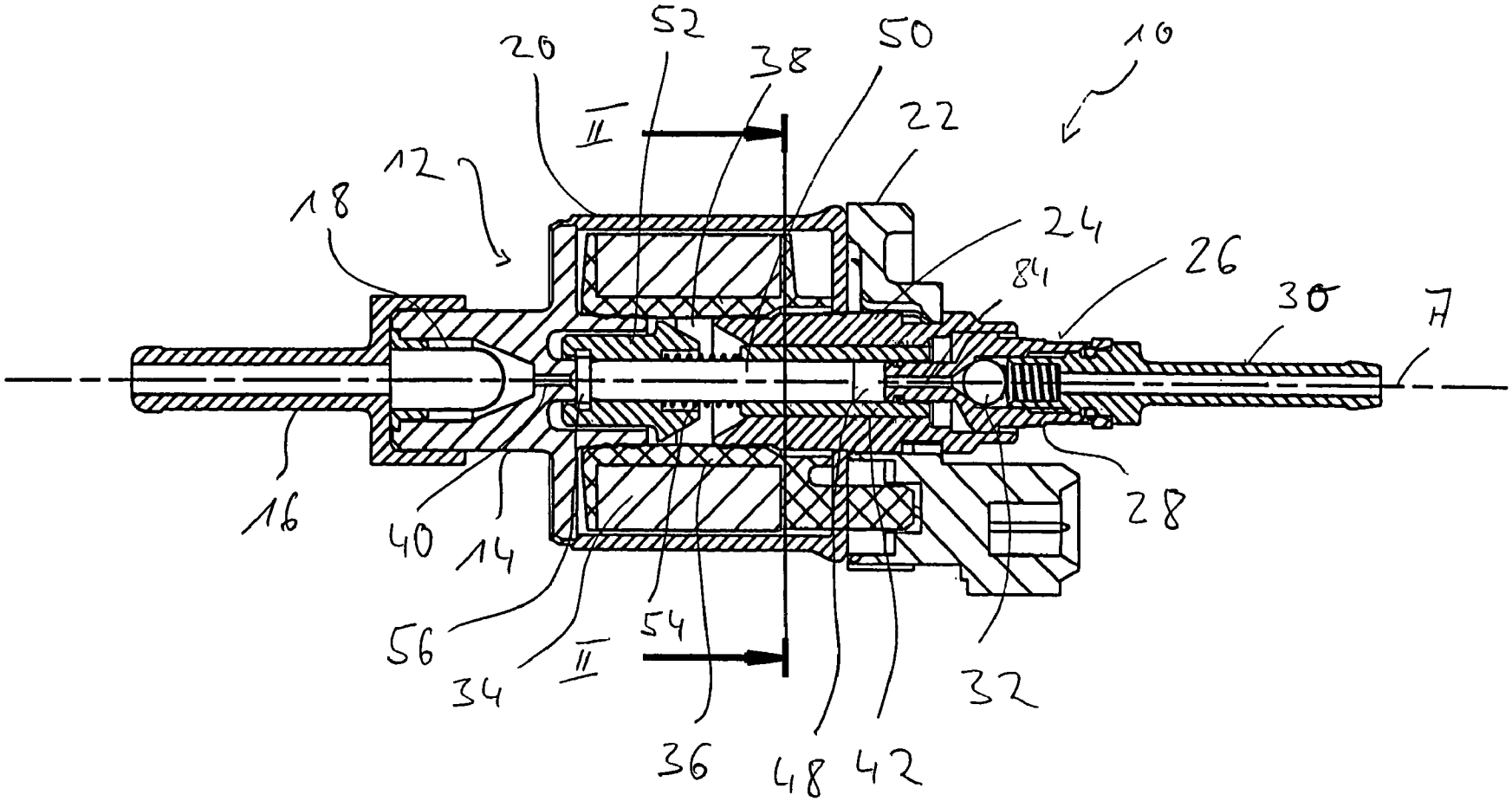
FIG. 1 is a longitudinal sectional view of a metering pump, cut along line I-I in FIG. 2.

Referring to the drawings in particular, a metering pump designed according to the present invention is generally designated by 10 in FIG. 1. This metering pump 10 can be used to deliver liquid fuel from a tank provided in a motor vehicle in the direction of a heater, e.g., a parking heater or an auxiliary heater.

The metering pump 10 comprises a housing arrangement 12, which is composed of a plurality of components. Thus, a housing end part 14 is provided, on which an inlet pipe connection 16, which is to be connected with a flexible tube connection, is provided. Furthermore, a filter 18 is provided in the housing end part 14. A housing outer wall 20 is rigidly connected with the housing end part 14 in the outer circumferential area, and the housing outer wall 20 is connected with another housing end part 22 at its other axial end area, axially being related to a longitudinal axis of the entire metering pump 10. An elongated, sleeve-like carrier element 24 is carried at this additional housing end part 22 in the radially inner area, radially being again related to the longitudinal axis A. This sleeve-like carrier element 24 carries, in turn, a non-return discharge valve 26, which comprises a part 28 providing essentially a valve seat and an outlet pipe connection 30 that can be connected with a flexible tube. A spring-pretensioned valve ball 32, which prevents the liquid fuel being delivered into the outlet pipe connection 30 from flowing back, is seated on the valve.

An electromagnet coil designated generally by 34 is carried on the housing end part 14 and the carrier element 24. The housing end part 14, a coil carrier 36 of the electromagnet coil 34 and the carrier element 24 define a pump inlet chamber 38, to which an inlet opening 40 provided in the housing end part 14 leads.

Figure 2:
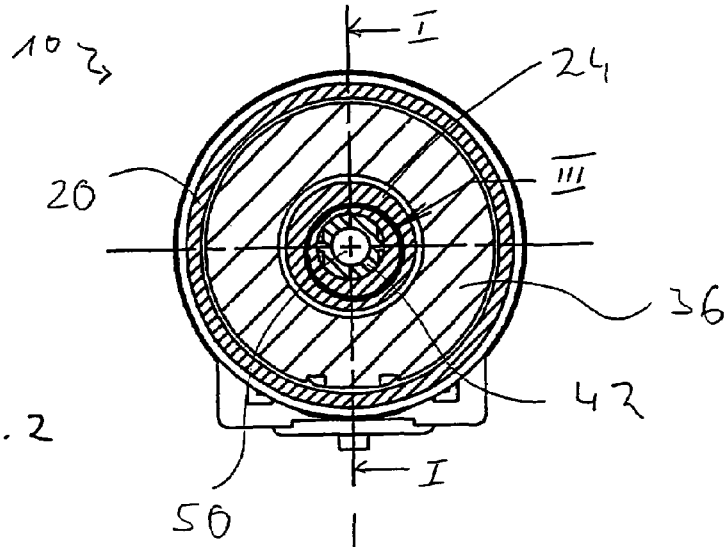
FIG. 2 is a cross-sectional view of the metering pump shown in FIG. 1, cut along line II-II in FIG. 1.

The carrier element 24, which has, as can be recognized from FIG. 2, generally an annular cross section, carries with its inner surface a guide sleeve 42. This guide sleeve 42, which likewise has a generally annular cross section and will be described in detail below with reference to FIGS. 3 and 4, has an interior space 44, which has, for example, a circular cross section. This interior space 44, which is defined by an inner surface 46, defines a pump ejection chamber 48 in cooperation with the part 28 of the valve arrangement 26 and is used, furthermore, to guide a delivery plunger 50 for moving to and fro in the direction of the longitudinal axis A. In its area not engaging the guide sleeve 42, the delivery plunger 50 carries an armature 52. Furthermore, the delivery plunger 50 is pretensioned by a pretensioning spring 54 such that it tends to move as far out of the interior space 44 of the guide sleeve 42 and to close the inlet opening 40 in the process with a sealing element 56, which is carried, for example, at the armature.

The guide sleeve 42, which is preferably made of a plastic material according to the principles of the present invention, is of an elongated shape and has essentially two length areas. The guide sleeve 42 is shaped in a first length area 58 such that the circumferential contour of an outer surface 60 of the guide sleeve corresponds to the circumferential contour of an inner surface 62 of the carrier element 24. This inner surface 62 is provided, for example, with an essentially circular contour in the example being shown, so that the guide sleeve 42 is likewise made with a circular outer surface in the first length area 58. Provisions may be made in this connection for the outside dimension of the guide sleeve 42 to have a certain oversize compared with the inner dimension of the carrier element 24 at least in this length area 58, so that a press fit is provided, in particular, in this first length area 58 with the guide sleeve 42 inserted into the carrier element 24 and stable mounting of the guide sleeve 42 is thus ensured.

In a second length area 64, the shape of the outer surface of the guide sleeve 42 differs from the shape of the inner surface 62 of the carrier element 24. It is recognized especially in FIG. 2 that the guide sleeve 42 is flattened at two circumferential areas located opposite each other, so that essentially flat, i.e., noncurved outer surface areas 70, 72 are formed. These outer surface areas 70, 72 are located at spaced locations from the inner surface 62 of the carrier element 24, so that a channel arrangement 74 is created between the carrier element 24 and the guide sleeve 42 in this second length area 64. This channel arrangement 74 joins the inlet chamber 38 and leads to passage openings 76, which are provided in the outer surface areas 70, 72 in the adjoining area to the first length area 58 of the guide sleeve 42 and lead into the interior space 44. The position of these openings 76 relative to the longitudinal extension of the guide sleeve 42 is selected to be such that when the delivery plunger 50 is maximally moved out of the guide sleeve 42, the end of the delivery plunger still engaging the guide sleeve 42 does not cover the openings 76 any longer or it does so only incompletely. With the delivery plunger 50 dipping maximally into the guide sleeve 42, i.e., in case of the minimum volume of the pump ejection chamber 58, the delivery plunger 50 covers the openings 76, so that a connection between the pump ejection chamber 48 and the channel arrangement 74 and consequently the pump inlet chamber 38 is now interrupted.

Figure 3:
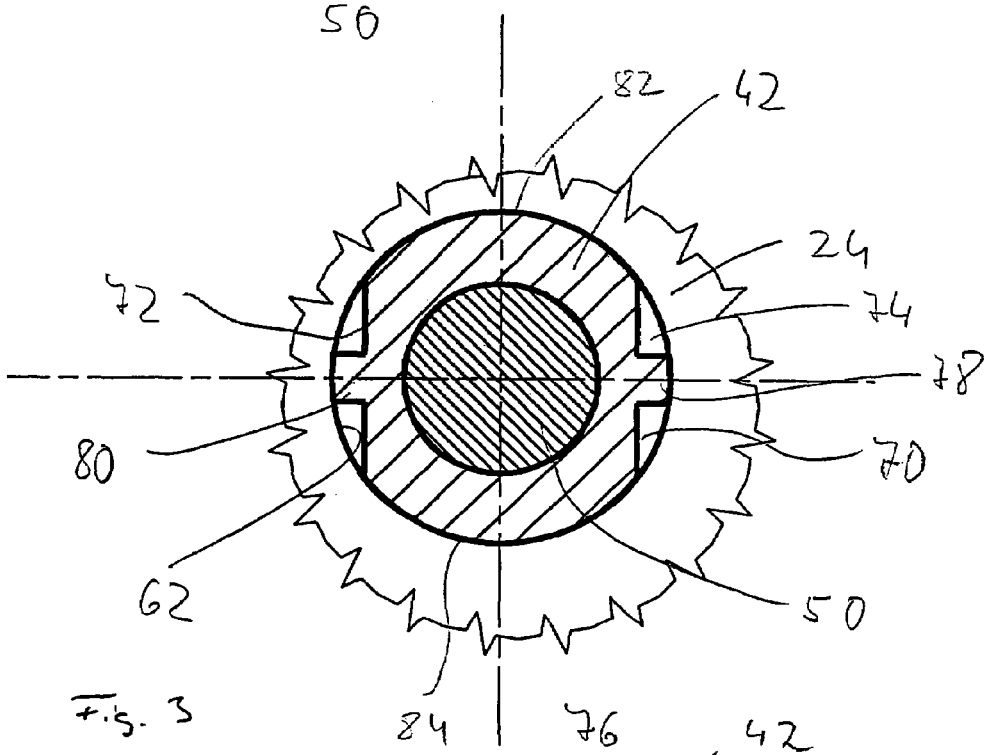
FIG. 3 is an enlarged detail of III in FIG. 2.
Figure 4:
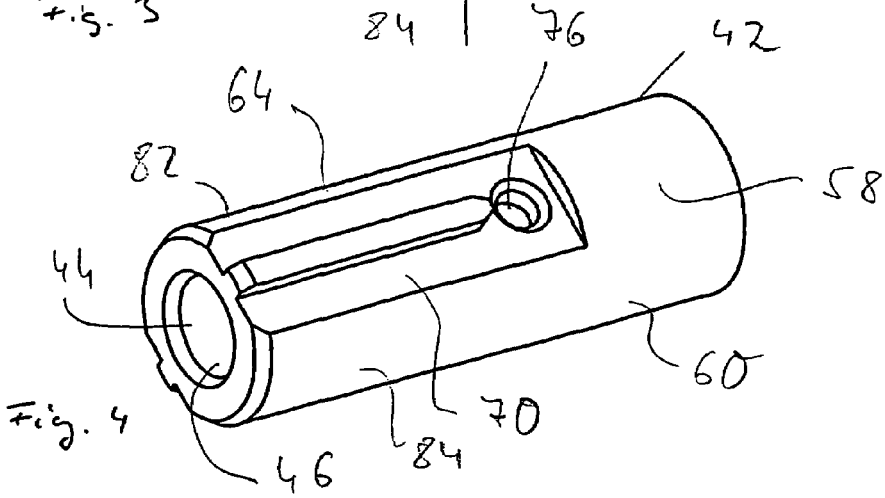
FIG. 4 is a perspective view of a guide sleeve used in the metering pump according to FIG. 1.

It is, furthermore, recognized from FIGS. 3 and 4 that a support section 78, 80 is provided in each of the flattened surface areas 70, 72. The support sections 78, 80 extend in the example being shown from the end area of the guide sleeve 42 located close to the inlet chamber 38 into the area in which a particular passage opening 76 is formed. The amount of projection of the support sections 78, 80 over the respective flattened surface area 70, 72 is selected to be such that these support sections 78, 80 extend radially approximately up to the level of the outer surface 60 in the first length area 58, doing so in the circumferential area in which a corresponding support section 78, 80 will then also adjoin.

Thus, not only is a stable hold of the guide sleeve, which is secured against evading movements, achieved in the first length area 58 when the guide sleeve 42 is inserted into the carrier element 24, but it is also ensured, despite the fact that the channel arrangement 74 is provided, that stable supporting is provided for the guide sleeve 42 in the second length area 64 as well in practically any direction, so that the guide sleeve 42 can nevertheless provide a stable guiding function for the delivery plunger 50 despite the fact that it can be made of a plastic material, which is considerably more flexible than a metallic material.

The function of the metering pump 10 according to the present invention will be described below.

If the delivery plunger 50 is in the position shown in FIG. 1, in which the volume of the pump ejection chamber 48 has its maximum, and the electromagnet arrangement 34 is then excited, the armature 52 moves together with the delivery plunger 50 in the direction in which the volume of the pump ejection chamber decreases. The delivery plunger 50 completely covers the openings 76 in the guide sleeve 42 already after a short delivery stroke, so that no fuel contained in the pump ejection chamber 48 at that point in time can be displaced back in the direction of the inlet chamber 38 via the openings 76. During a subsequent further minimization of the volume of the pump ejection chamber 48, the fuel contained therein is displaced through an outlet opening 84 of the part 28, so that the valve ball 32 will also lift off from its valve seat and the fuel being delivered can be released via the outlet pipe connection 30 while overcoming the valve arrangement 26. Liquid fuel is also drawn at the same time into the inlet chamber 38 during this delivery cycle due to the increase in the volume of the inlet chamber 38 due to the fact that the delivery plunger 50 dips more deeply into the guide sleeve 42.

If the excitation of the electromagnet arrangement 34 is terminated after the minimum volume of the pump ejection chamber 48 had been reached, the delivery plunger 50 returns under the pretension in the direction of increasing pump ejection chamber volume and a vacuum is generated during this phase in this pump ejection chamber 48 as long as the openings 76 are still being covered by the delivery plunger 50. At the same time, overpressure is generated in the inlet chamber 38 by the delivery plunger 50 moving out of the guide sleeve 42. A certain percentage of the liquid fuel can now escape through the inlet opening 40. However, as the escape via the inlet opening 40 is becoming increasingly difficult and the connection between the pump ejection chamber 48 and the inlet chamber 38 is released, the fuel is then displaced via the channel arrangement 74 into the pump ejection chamber 48, so that another quantity of fuel is then delivered in the direction of the outlet pipe connection 30 during a subsequent reduction of the volume of the pump ejection chamber 48.

Due to the use of a guide sleeve made of a plastic material, which can be optimized in terms of its sliding properties, on the one hand, and concerning the resistance to the medium to be delivered, on the other hand, the wear due to the frictional contact between the delivery plunger 50 and the guide sleeve 42 can be markedly reduced. Due to the fact that the guide sleeve 42 is also supported in the length area in which it defines the channel arrangement 74 together with the carrier element 24, it is ensured at the same time that very stable mounting is nevertheless achieved if plastic material is used for this guide sleeve 42.

It shall be pointed out that the shape of the guide sleeve 42 may, of course, be different in its second length area 64. For example, splitting at an angle ratio other than 180° is possible. It is, of course, also possible to provide the channel arrangement 74 by groove-like depressions of a different shape, which are open radially outwardly and extend along the guide sleeve 42 to one or more of the openings 76. The variant that can be recognized in FIGS. 3 and 4 can ultimately also be interpreted such that an interruption of the outer surface 60 that otherwise corresponds to the shape in the first length area 58 is generated in certain circumferential areas in the second length area 64, so that support of the guide sleeve 42 is achieved not only via the two support sections 78, 80, but the guide sleeve is also supported in relation to the carrier element 24 in the circumferential areas 82, 84 located between the two surface areas 70, 72, which are flattened and thus provide the groove-like depressions. In case of corresponding stability of the guide sleeve 42, it would optionally be possible to ensure support only via such circumferential areas 82, 84, which also act as support areas, and to do away with the support sections 78, 80.

While a specific embodiment of the invention has been shown and described in detail to illustrate the application of the principles of the invention, it will be understood that the invention may be embodied otherwise without departing from such principles.

What is claimed is:

1. A metering pump comprising:

a delivery plunger which can be reciprocally moved to and fro in an axial direction between a first axial position and a second axial position to deliver liquid medium;

a guide sleeve which partially accommodates said delivery plunger and guides said delivery plunger for the reciprocating movement, said guide sleeve with an inner surface thereof defining a pump ejection chamber and with an outer surface thereof defining a channel arrangement leading to said pump ejection chamber;

a carrier element, said guide sleeve being carried in said carrier element and said guide sleeve having a first axial length area with an outer circumferential surface in contact with said carrier element essentially over an entire outer circumference of said guide sleeve and said guide sleeve having a second axial length area with an outer surface located at a spaced location from said carrier element, wherein said channel arrangement is provided between said carrier element and said guide sleeve in said second length area, said guide sleeve having at least one support area in said second length area for supporting said guide sleeve in relation to said carrier element, said guide sleeve defining said pump ejection chamber essentially in said first axial length area, said guide sleeve defining said channel arrangement essentially in said second axial length area, said guide sleeve having at least one passage opening, said at least one passage opening defining a means for communicating said channel arrangement with said pump ejection chamber, said at least one passage opening being in communication with said pump ejection chamber when said delivery plunger is in said first axial position, said delivery plunger closing said at least one passage opening when said plunger is in said second axial position such that said channel arrangement is not in communication with said pump ejection chamber.

2. A metering pump in accordance with claim 1, wherein in said second length area said guide sleeve has an outer contour that corresponds to an outer contour of said guide sleeve in said first length area and is interrupted at at least one circumferential area by a depression, which is open toward the outside and provides the channel arrangement at least partially.

3. A metering pump in accordance with claim 1, wherein the guide sleeve is made of a plastic material.

4. A metering pump in accordance with claim 1, wherein said outer surface of said guide sleeve defines a first flat surface and a second flat surface in said axial length area, said outer surface defining a first projection extending from said first flat surface and a second projection extending from said second flat surface, said first projection being located opposite said second projection.

5. A metering pump in accordance with claim 4, wherein said guide sleeve is composed of plastic, said first projection and said second projection engaging an inner surface of said carrier element.

6. A metering pump, comprising:

a delivery plunger mounted for reciprocating movement such that said delivery plunger reciprocates in an axial direction to deliver liquid medium;

a guide sleeve receiving at least a portion of said delivery plunger and guiding said delivery plunger for said reciprocating movement, said guide sleeve having a guide sleeve inner surface and a guide sleeve outer surface;

a carrier element, said guide sleeve being located in said carrier element, said guide sleeve inner surface and one end of said delivery plunger defining a pump ejection chamber, said guide sleeve outer surface defining a circumferential outer sleeve portion and an axial length area, said circumferential outer sleeve portion having a first axial length, said axial length area having a second axial length, said guide sleeve outer surface defining a channel arrangement at said axial length area such that said channel arrangement is located between said carrier element and said guide sleeve, said circumferential outer sleeve portion extending along an inner surface of said carrier element such that said circumferential outer sleeve portion is in contact with said carrier element along an entire outer circumference of said guide sleeve, said guide sleeve outer surface being located at a spaced location from said carrier element at said axial length area, said pump ejection chamber being located opposite said circumferential outer sleeve portion, wherein said delivery plunger is reciprocated from a first axial position to a second axial position, said guide sleeve outer surface having an opening, one side of said opening being in communication with said channel arrangement, another side of said opening being at least partially in communication with said pump ejection chamber when said delivery plunger is in said first position, said delivery plunger closing said another side of said opening in said second position such that said opening is not in communication with said pump ejection chamber.

7. A metering pump comprising:

a delivery plunger which can be reciprocally moved to and fro in an axial direction between a first axial position and a second axial position to deliver liquid medium;

a guide sleeve which partially accommodates said delivery plunger and guides said delivery plunger for the reciprocating movement, said guide sleeve with an inner surface thereof defining a pump ejection chamber and with an outer surface thereof defining a channel arrangement leading to said pump ejection chamber;

a carrier element, said guide sleeve being carried in said carrier element and said guide sleeve having a first axial length area with an outer circumferential surface in contact with said carrier element essentially over an entire outer circumference of said guide sleeve and said guide sleeve having a second axial length area with an outer surface located at a spaced location from said carrier element, wherein said channel arrangement is provided between said carrier element and said guide sleeve in said second length area, said guide sleeve having at least one support area in said second length area for supporting said guide sleeve in relation to said carrier element, said guide sleeve defining said pump ejection chamber essentially in said first axial length area, said guide sleeve defining said channel arrangement essentially in said second axial length area, said guide sleeve having at least one passage opening, said at least one passage opening defining a means for communicating said channel arrangement with said pump ejection chamber, said at least one passage opening being in communication with said pump ejection chamber when said delivery plunger is in said first axial position, said delivery plunger closing said at least one passage opening when said plunger is in said second axial position such that said channel arrangement is not in communication with said pump ejection chamber, said guide sleeve having a set-back outer surface, set back in relation to said outer surface of said first length area, in at least one circumferential area of said second length area, wherein in the area of the set-back outer surface a support section is provided projecting over said set-back outer surface, wherein said at least one passage opening leads to said pump ejection chamber and is provided in a region in which said first length area adjoins said second length area.

8. A metering pump in accordance with claim 7, wherein said support section projects over said set-back outer surface up to a level of said outer surface of said first length area.

9. A metering pump in accordance with claim 7, wherein said set-back outer surface is provided at two essentially mutually opposite circumferential areas in the second length area.

10. A metering pump comprising:

a delivery plunger which can be reciprocally moved to and fro in an axial direction between a first axial position and a second axial position to deliver liquid medium;

a guide sleeve which partially accommodates said delivery plunger and guides said delivery plunger for the reciprocating movement, said guide sleeve with an inner surface thereof defining a pump ejection chamber and with an outer surface thereof defining a channel arrangement leading to said pump ejection chamber;

a carrier element, said guide sleeve being carried in said carrier element and said guide sleeve having a first axial length area with an outer circumferential surface in contact with said carrier element essentially over an entire outer circumference of said guide sleeve and said guide sleeve having a second axial length area with an outer surface located at a spaced location from said carrier element, wherein said channel arrangement is provided between said carrier element and said guide sleeve in said second length area, said guide sleeve having at least one support area in said second length area for supporting said guide sleeve in relation to said carrier element, said guide sleeve defining said pump ejection chamber essentially in said first axial length area, said guide sleeve defining said channel arrangement essentially in said second axial length area, said guide sleeve having at least one passage opening, said at least one passage opening defining a means for communicating said channel arrangement with said pump ejection chamber, said at least one passage opening being in communication with said pump ejection chamber when said delivery plunger is in said first axial position, said delivery plunger closing said at least one passage opening when said plunger is in said second axial position such that said channel arrangement is not in communication with said pump ejection chamber, wherein said at least one passage opening leads to said pump ejection chamber and said at least one passage opening is provided in a region in which said first length area adjoins said second length area.

* * * * *